US010718212B2

(12) United States Patent
Jahrmarcht et al.

(10) Patent No.: US 10,718,212 B2
(45) Date of Patent: Jul. 21, 2020

(54) ROTOR FOR A TURBOMACHINE

(71) Applicant: Siemens Aktiengesellschaft, Munich (DE)

(72) Inventors: Steffen Jahrmarcht, Duisburg (DE); Kevin Miny, Essen (DE)

(73) Assignee: Siemens Aktiengesellschaft, Munich (DE)

( * ) Notice: Subject to any disclaimer, the term of this patent is extended or adjusted under 35 U.S.C. 154(b) by 101 days.

(21) Appl. No.: 15/781,719

(22) PCT Filed: Nov. 21, 2016

(86) PCT No.: PCT/EP2016/078306
§ 371 (c)(1),
(2) Date: Jun. 6, 2018

(87) PCT Pub. No.: WO2017/102254
PCT Pub. Date: Jun. 22, 2017

(65) Prior Publication Data

US 2018/0371916 A1 Dec. 27, 2018

(30) Foreign Application Priority Data

Dec. 16, 2015 (DE) ..... 10 2015 225 428

(51) Int. Cl.
*F01D 5/06* (2006.01)
*F04D 17/12* (2006.01)
(Continued)

(52) U.S. Cl.
CPC ..... *F01D 5/066* (2013.01); *F01D 5/026* (2013.01); *F04D 17/122* (2013.01);
(Continued)

(58) Field of Classification Search
None
See application file for complete search history.

(56) References Cited

U.S. PATENT DOCUMENTS 3,715,176 A * 2/1973 Kerklo ..... F01D 5/043 416/198 R
4,497,612 A * 2/1985 Knorowski ..... F01D 5/025 416/198 A
(Continued)

FOREIGN PATENT DOCUMENTS

EP 2365185 A2 9/2011
FR 2406121 A1 5/1979
(Continued)

OTHER PUBLICATIONS

DE Search Report dated Mar. 30, 2016, for DE patent application No. 102015225428.3.
(Continued)

*Primary Examiner* — Igor Kershteyn
*Assistant Examiner* — Jason G Davis
(74) *Attorney, Agent, or Firm* — Beusse Wolter Sanks & Maire

(57) ABSTRACT

A rotor for a turbomachine, includes a plurality of axially adjacently arranged rotor segments which are each provided with a central opening, an individual tie rod extending through the openings of the rotor segments, and two holding devices which are arranged on axially opposing ends of the tie rod and hold the rotor segments together, the rotor segments forming at least two rotor segment groups between which at least one other holding device is arranged.

6 Claims, 1 Drawing Sheet

(51) Int. Cl.

| | |
|---|---|
| ***F04D 29/054*** | (2006.01) |
| ***F01D 5/02*** | (2006.01) |
| ***F04D 29/62*** | (2006.01) |

(52) U.S. Cl.

CPC ..... *F04D 29/054* (2013.01); *F04D 29/624* (2013.01); *F05D 2230/51* (2013.01); *F05D 2240/60* (2013.01); *F05D 2260/31* (2013.01); *F05D 2260/96* (2013.01)

(56) References Cited

U.S. PATENT DOCUMENTS

| | | | |
|---|---|---|---|
| 2011/0223026 | A1 | 9/2011 | Benjamin et al. |
| 2011/0262284 | A1 | 10/2011 | Guernard |
| 2015/0247406 | A1 | 9/2015 | Costamagna et al. |
| 2015/0260044 | A1 | 9/2015 | Costamagna et al. |

FOREIGN PATENT DOCUMENTS

| | | | |
|---|---|---|---|
| JP | 3042095 | B2 | 5/2000 |
| JP | 2006138255 | A | 6/2006 |
| RU | 2551453 | C2 | 5/2015 |
| WO | 2014037521 | A1 | 3/2014 |
| WO | 2015091436 | A1 | 6/2015 |

OTHER PUBLICATIONS

International Search Report dated Feb. 9, 2017, for PCT/EP2016/078306.

* cited by examiner

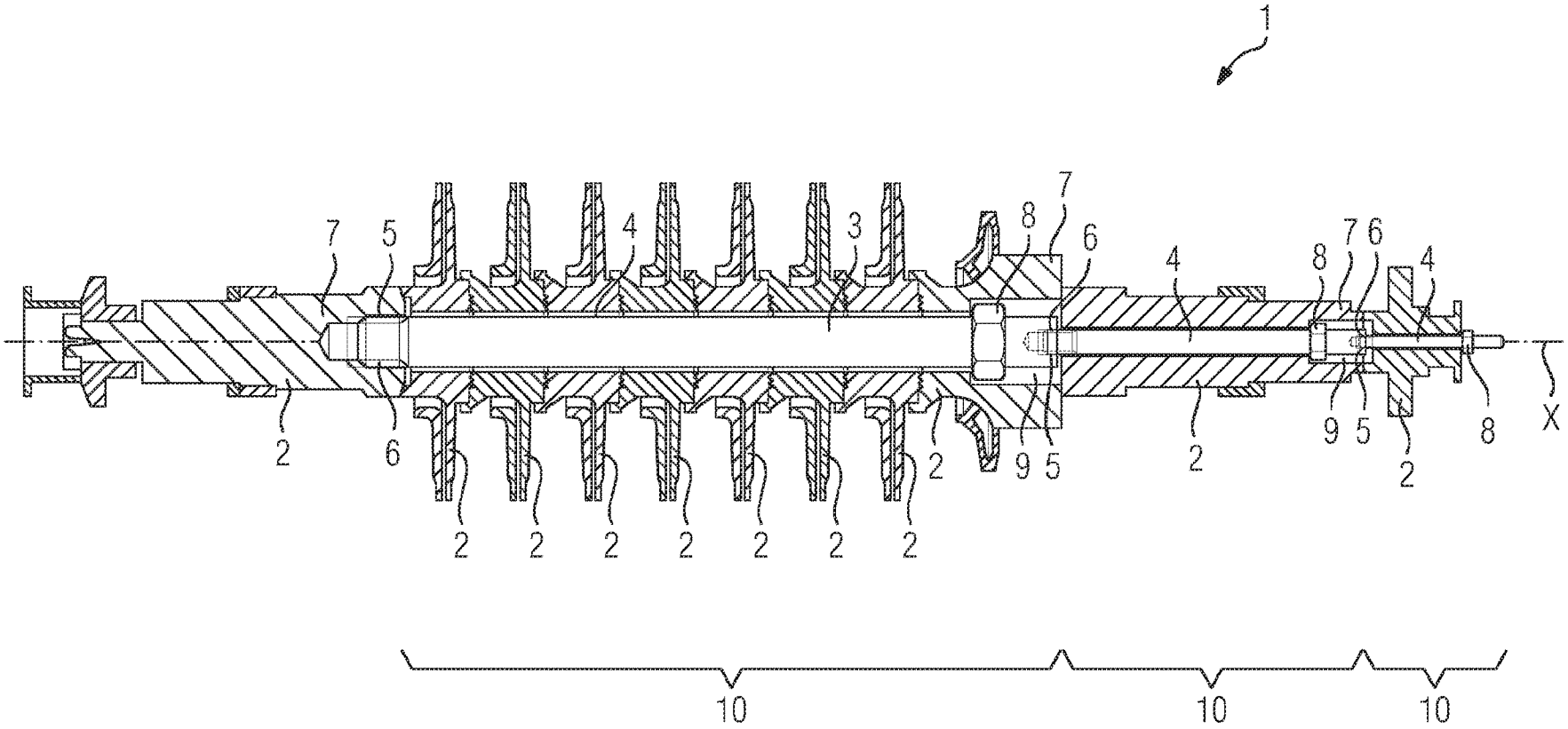
1
X
8
4
2
7
6
5
9
3
10

ROTOR FOR A TURBOMACHINE

CROSS REFERENCE TO RELATED APPLICATIONS

This application is the US National Stage of International Application No. PCT/EP2016/078306 filed Nov. 21, 2016, and claims the benefit thereof. The International Application claims the benefit of German Application No. DE 102015225428.3 filed Dec. 16, 2015. All of the applications are incorporated by reference herein in their entirety.

FIELD OF INVENTION

The invention relates to a rotor for a turbomachine, comprising a plurality of rotor segments which are each provided with a central opening and are arranged axially adjacent to one another, a single tie rod which extends through the openings of the rotor segments, and two bracing means which are arranged at axially opposite ends of the tie rod and brace the rotor segments against one another.

BACKGROUND OF INVENTION

Rotors of said type are known in the prior art in a variety of configurations and serve for converting forms of energy into one another in turbomachines. For example, the flow energy and/or enthalpy of a working fluid in a steam/gas turbine can be converted into rotational energy of a rotor (turbine rotor). Alternatively, a rotor driven in a rotating manner can be used to draw in an arbitrary gas, and to compress said gas for further use within an industrial process (compressor rotor).

Known rotors comprise a plurality of rotor segments which are each provided with a central opening and which are arranged axially adjacent to one another. Some of the rotor segments are in this case formed as so-called rotor disks, which each bear a ring of radially extending blades (rotor blades). Furthermore, such a rotor usually comprises a single central tie rod which extends through the openings of the rotor segments. Two bracing means which brace the rotor segments against one another are arranged at axially opposite ends of the tie rod.

During the operation of a turbomachine, the tie rod is caused to oscillate. Here, oscillation frequencies equal to or close to the natural frequency of the tie rod are to be avoided since such resonance oscillations of the tie rod can impair the function of the turbomachine or can lead to damage/destruction of the tie rod.

Turbine rotors are normally operated at a low rotational frequency, which substantially corresponds to the grid frequency of the respective power grid. The natural frequencies of the tie rods installed in turbine rotors are correspondingly generally well above said rotational frequency, and for this reason damaging resonance oscillations of the tie rod in turbine stages can scarcely occur.

The situation is different for compressor rotors since these are operated at rotational frequencies which are as high as possible. This is because the higher the rotational frequency, the greater the attainable compressor power. If the natural frequency of the tie rod of a compressor rotor must not be below the rotational frequency of the compressor rotor, this therefore constitutes a power-limiting factor for the compressor power.

Against this background, it is desirable to increase the natural frequency of the tie rod, in particular of a compressor rotor, which natural frequency is determined in principle by the dimensions and material properties of the tie rod and by the tensile force exerted on the tie rod with the aid of the bracing means. Here, said factors have different effects on the natural frequency of the tie rod.

The longer the free oscillation length of the tie rod, the lower the natural frequency of the tie rod. The plurality of rotor disks and further rotor segments may well result in a length for the compressor rotor, and thus also for the tie rod passing therethrough, which length is associated with a relatively low natural frequency of the tie rod, and this considerably limits the possible rotational frequencies of the compressor rotor.

By contrast, the larger the tensile force exerted on the tie rod via the bracing means, the higher the natural frequency of the tie rod. Consequently, the natural frequency of a tie rod can be increased by the rotor segments being braced against one another with greater intensity. However, the tensile force of the tie rod cannot be increased to an arbitrary extent since, by virtue of its material and dimensions, a maximum permissible tensile force must not be exceeded for the tie rod in order to avoid damaging or breaking the tie rod.

It is therefore not always possible in practice for a sufficiently high natural frequency of the tie rod to be structurally set in order to achieve a desired compressor power.

Said problem has hitherto been countered in that use has been made of different tie rod arrangements, which generally consist of multiple shorter, decentrally arranged tie rods. However, a disadvantage of this solution is that advantages associated with a single central tie rod, such as for example simple production and assembly, are no longer able to be realized.

Further rotors of the type mentioned in the introduction are described in the documents WO 2015/091436 A1, WO 2014/037521 A1 and JP 2006 138 255 A.

SUMMARY OF INVENTION

It is therefore an object of the present invention to provide an improved rotor which overcomes said disadvantages and permits higher rotational frequencies.

In order to achieve said object, the present invention provides a rotor of the type mentioned in the introduction, the rotor segments of which form at least two rotor segment groups, between which at least one further bracing means is arranged.

The invention is therefore based on the concept of dividing the rotor segments into at least two rotor segment groups and providing at least one further bracing means therebetween. This at least one further bracing means is used for bracing, together with an end-side bracing means, the rotor segments of one of the two rotor segment groups against one another. The rotor segments of the second rotor segment group are then braced by the opposite end-side bracing means against the rotor segment group which is already braced. In this way, the original oscillation length of the tie rod between the two end-side bracing means is subdivided into two shorter oscillation lengths, as a result of which the original natural frequency of the tie rod is replaced by two higher natural frequencies of the shorter tie rod sections. Correspondingly, the maximum possible rotational frequency of the rotor is increased.

The tie rod comprises a plurality of tie rod sections which are arranged axially adjacent to one another and are associated with in each case one rotor segment group. A tie rod which is subdivided into multiple sections in this manner can be optimally adapted with regard to the different rotor segment groups and facilitate the arrangement and function of further bracing means between the rotor segment groups.

According to the invention, the tie rod sections are of cylindrical form, wherein, starting from one end of the tie rod, the cylinder diameters of the tie rod sections decrease in a stepwise manner with a stepped outer contour being formed. A tie rod which is stepped in this manner permits simple handling of the further bracing means when the latter are being arranged and adjusted. Furthermore, such a tie rod can be produced as a single part without any problems.

According to an embodiment of the present invention, the bracing means comprise a stop element and a pressure element which is adjustable for the purpose of bracing and by way of which the rotor segments of a rotor segment group are acted on by an axial force in the direction of the stop element. Stop elements and pressure elements constitute common bracing means for bracing rotor segments against one another. By adjusting the pressure element in the direction of the stop element, the rotor segments of the rotor segment group can be acted on by the axial tensile force of the tie rod.

Advantageously, at least one stop element is formed by a rotor element. This reduces the number of required bracing means and thus of components required for the rotor.

According to one variant of the present invention, the at least one stop element is formed by a rotor segment which has an axially extending threaded bore into which an outer thread formed at a free end of the tie rod is screwed. Said rotor segment then forms one end of the tie rod and may serve for example for the mounting of the rotor in a housing of the turbomachine.

According to a further variant of the present invention, the at least one stop element may be formed by a rotor segment of an adjacent rotor segment group.

According to the invention, at least one pressure element is formed by a nut which is screwed onto an outer thread of the tie rod, said nut being arranged in a receiving space, defined by at least one rotor segment, and pressing against an adjacent rotor segment. Such nuts constitute standardized, readily available components which, when the pitch of the outer thread of the tie rod is correspondingly small, permit precise setting of the force exerted on the rotor segments.

Adjacent tie rod sections may also be screwed to one another, wherein a tie rod section has an axially extending threaded bore into which an outer thread formed at a free end of the adjacent tie rod section is screwed. A tie rod which is able to be disassembled offers advantages in transport and in production. Screw connections facilitate the assembly of the individual tie rod sections.

BRIEF DESCRIPTION OF THE DRAWINGS

Further features and advantages of the present invention will become clear from the following description of an embodiment of the rotor according to the invention with reference to the appended drawing, in which FIG. 1 is a cross-sectional view of a rotor according to an embodiment of the present invention.

DETAILED DESCRIPTION OF INVENTION

FIG. 1 shows a rotor 1 for a turbomachine (not illustrated), which rotor can be installed for example as a compressor rotor in a radial compressor. The rotor 1 comprises a plurality of rotor segments 2 which are arranged axially adjacent to one another. The rotor segments 2 have Hirth toothings and are each provided with a central opening through which a single tie rod 3 extends. The tie rod 3 comprises a plurality of tie rod sections 4 which are arranged axially adjacent to one another. The tie rod sections 4 are of cylindrical form, wherein, starting from one end of the tie rod 3, the cylinder diameters of the tie rod sections 4 decrease in a stepwise manner with a stepped outer contour being formed. Adjacent tie rod sections 4 are connected to one another by way of a screw connection. Here, in each case one tie rod section 4 has an axially extending threaded bore 5 into which an outer thread 6 formed at a free end of the adjacent tie rod section 4 is screwed. It goes without saying that it is also possible for the tie rod sections to be connected or screwed to one another in another way. A single-part formation is also possible.

The rotor 1 also comprises bracing means 7, 8, which are arranged at axially opposite ends of the tie rod 3 and brace the rotor segments 2 against one another, and further bracing means 7, 8, which are arranged between the rotor elements 2.

The bracing means 7, 8 comprise firstly stop elements 7 which, in the present case, are each formed by a rotor segment 2. Here, a rotor segment 2 serving as a stop element 7 is arranged at a free end of the tie rod 3 and has an axially extending threaded bore 5 into which an outer thread 6 formed at the free end of the tie rod 3 is screwed. However, stop elements 7 may also be provided as separate components, which do not form a rotor segment 2.

Secondly, the bracing means 7, 8 comprise multiple pressure elements 8 which are axially adjustable for the purpose of bracing and by way of which the rotor segments 2 are acted on by an axial force in the direction of in each case corresponding stop elements 7. In the present case, each pressure element 8 is formed by a nut 8 which is screwed onto an outer thread 6 of the tie rod 3, said nut being arranged in a receiving space 9, defined by a rotor segment 2, and pressing against said rotor segment 2. It is alternatively possible, however, for pressure elements to be formed by rotor segments whose central opening is formed for example as a threaded bore.

In the illustrated exemplary embodiment, the rotor segments 2 form three rotor segment groups 10, between which in each case one stop element 7 and one pressure element 8 are arranged. A rotor segment group 10 may in this case comprise a single rotor segment 2 or a plurality of rotor segments 2. Each rotor segment group 10 is associated with a tie rod section 4. However, the number of rotor segment groups 10 can vary according to the structure of the rotor 1.

During the operation of the turbomachine, the rotor 1 rotates about an axis of rotation X. The rotation of the rotor 1 sets the tie rod 3 in oscillation, wherein the oscillations of the tie rod 3 occur in isolation in each tie rod section 4. Since the lengths of the individual tie rod sections 4 are shorter than the length of the entire tie rod 3, the natural frequencies of the tie rod sections 4 are each well above the natural frequency of a tie rod of equal overall length which is not subdivided into multiple sections. This ensures that, during the operation of the turbomachine, the oscillation frequencies of the tie rod 3 remain well below the respective natural frequencies. In this way, the occurrence of damaging resonance oscillations of the tie rod 3 is reliably excluded without, however, giving up the advantages associated with a single central tie rod 3, such as for example simple production and assembly.

Although the invention has been more specifically illustrated and described in detail by the preferred exemplary embodiment, the invention is not limited by the examples disclosed, and other variations can be derived therefrom by a person skilled in the art without departing from the scope of protection of the invention.

The invention claimed is:

1. A rotor for a turbomachine, comprising:

a plurality of rotor segments which are each provided with a central opening and are arranged axially adjacent to one another, wherein the plurality of rotor segments form a plurality of rotor segment groups, a single tie rod which extends through the central openings of the plurality of rotor segments, and plural braces comprising two braces which are arranged at axially opposite ends of the single tie rod and which brace the plurality of rotor segments against one another and a brace disposed between adjacent rotor segment groups of the plurality of rotor segment groups, wherein the single tie rod comprises a plurality of cylindrical tie rod sections which are arranged axially adjacent to one another and are associated with in each case one rotor segment group of the plurality of rotor segment groups, wherein, starting from one end of the single tie rod, cylinder diameters of cylindrical tie rod sections of the plurality of cylindrical tie rod sections decrease in a stepwise manner thereby forming a stepped outer contour of the single tie rod, and wherein at least one brace of the plural braces comprises a pressure element which is axially adjustable for the purpose of bracing and by way of which the plurality of rotor segments are acted on by an axial force in a direction of in each case corresponding stop elements, wherein each pressure element is formed by a nut which is screwed onto an outer thread of an associated cylindrical tie rod section of the plurality of cylindrical tie rod sections, and wherein at least one nut is arranged in a respective receiving space defined by an associated rotor segment of the plurality of rotor segments and pressing against said respective rotor segment.

2. The rotor as claimed in claim 1, wherein at least one stop element of the corresponding stop elements is formed by a rotor segment of the plurality of rotor segments.

3. The rotor as claimed in claim 2, wherein the at least one stop element comprises an axially extending threaded bore into which an outer thread formed at a free end of an adjacent cylindrical tie rod section of the plurality of cylindrical tie rod sections is screwed.

4. The rotor as claimed claim 2, wherein the at least one stop element is formed by a rotor segment of an adjacent rotor segment group of the plurality of rotor segment groups.

5. The rotor as claimed in claim 1, wherein the nut presses against the associated rotor segment.

6. The rotor as claimed in claim 1, wherein adjacent cylindrical tie rod sections of the plurality of cylindrical tie rod sections are screwed to one another, wherein a first cylindrical tie rod section of the adjacent cylindrical tie rod sections comprises an axially extending threaded bore into which an outer thread formed at a free end of a second cylindrical tie rod section of the adjacent cylindrical tie rod sections is screwed.

* * * * *